United States Patent [19]

Dixon et al.

[11] Patent Number: 4,867,221

[45] Date of Patent: Sep. 19, 1989

[54] FLAT FOLDING PARTITION

[75] Inventors: Guy E. Dixon, Key Largo; Howard B. Jacobus, Miramar; Florencio E. Soto, Miami, all of Fla.

[73] Assignee: Panelfold, Inc., Miami, Fla.

[21] Appl. No.: 89,777

[22] Filed: Aug. 27, 1987

[51] Int. Cl.[4] ..... E06B 3/94

[52] U.S. Cl. ..... 160/84.1; 160/199

[58] Field of Search ..... 160/84.1, 84.2, 84.3, 160/33, 199, 118; 52/67

[56] References Cited

U.S. PATENT DOCUMENTS

| | | | |
|---|---|---|---|
| 2,801,687 | 8/1957 | Ensign et al. | 160/84.2 |
| 3,029,867 | 4/1962 | Maurer | 160/84.2 |
| 3,065,786 | 11/1962 | Stansbury | 160/84.2 |
| 3,979,861 | 9/1976 | Fromme et al. | 160/118 X |
| 4,199,018 | 4/1980 | Hirschel et al. | 160/84.1 |
| 4,598,751 | 7/1986 | Peeters-Weem | 160/84.1 |

FOREIGN PATENT DOCUMENTS

| | | | |
|---|---|---|---|
| 2912514 | 10/1980 | Fed. Rep. of Germany | 160/84.3 |

*Primary Examiner*—Alvin C. Chin-Shue
*Assistant Examiner*—David M. Purol
*Attorney, Agent, or Firm*—Fleit, Jacobson, Cohn, Price, Holman & Stern

[57] ABSTRACT

A folding partition having two rows of spaced, pivotally associated rigid panels supported by a trackway or the like with a control mechanism providing movement of the panels from a flat aligned condition when the partition is in closed position to an open position in which the panels are oriented in opposed surface-to-surface stacked relation generally in perpendicular relation to the position of the panels when in closed position. More specifically, a control mechanism interconnects the panels and biases the panels toward both a closed and open position for assisting in the opening and closing movement of the flat folding partition and holds the panels in both a closed position and an open position. The control mechanism also limits the movement of the panels toward closed position and transmits an opening force from preceding panels to succeeding panels when being moved in opening direction of movement with the control mechanism including a unique combination of control base, control lever, control plate, control cam, control cam follower and control cam spring to obtain the desired multiple functions.

21 Claims, 5 Drawing Sheets

FLAT FOLDING PARTITION

BACKGROUND OF THE INVENTION

Field of the Invention

The present invention relates to a folding partition having two rows of spaced, pivotally associated rigid panels supported by a trackway or the like with a control mechanism providing movement of the panels from a flat aligned condition when the partition is in closed position to an open position in which the panels are oriented in opposed surface-to-surface relation generally in perpendicular relation to the position of the panels when in closed position. More specifically, the control mechanism is a simple, small, compact structure which interconnects the panels and biases the panels toward both a closed and open position for assisting in the opening and closing movement of the flat folding partition and holds the panels in both a closed position and an open position. The control mechanism also limits movement of the panels toward the closed position by preventing inward movement past the closed planar position, controls the closing and opening movement of the panels and transmits an opening force from preceding panels to succeeding panels during opening movement with this mechanism including a unique combination of control base, control lever, control plate, control cam, control cam follower and control cam spring.

INFORMATION DISCLOSURE STATEMENT

Dual wall folding partitions and doors are generally well known and include spaced rows of pivotally interconnected panels supported from trackways or the like with various arrangements being provided for controlling the opening and closing movement of the panels when the partition or door is opened or closed. A separate information disclosure statement will be filed including copies of the prior art known to applicant and a discussion thereof.

SUMMARY OF THE INVENTION

An object of the present invention is to provide a flat folding partition which includes two rows of rigid panels oriented in spaced parallel planes when in closed position and movable to a stacked position when the partition is in open position with a control mechanism controlling the opening and closing movement of the panels and exerting a force on the panels during movement in the closing and opening directions to assist in opening and closing the partition and holding the panels in both open and closed positions.

Another object of the invention is to provide a flat folding partition in accordance with the preceding object in which the control mechanism includes a structure for transmitting an initial opening force from preceding panels to succeeding panels to sequentially move them from an initial closed, aligned position in spaced vertical planes by initially moving the hinged connection between adjacent panels outwardly of the vertical plane thereby moving the panels to angled relation.

A further object of the invention is to provide a flat folding partition as set forth in the preceding objects in which the control mechanism also includes levers of angulated configuration each having one end slidably guided and pivotal in guides on the panels with the other end being pivoted to a central portion of a carrying bar. A spring biases a free end of a pivotal cam mounted on the carrying bar and the cam has a cam surface engaged by a follower on the angled control lever so that when the control levers move through a dead center position, the springs will exert an opening and closing force which will be imparted to the panels through the angled control levers.

Still another object of the invention is to provide a flat folding partition in accordance with the preceding objects in which the spring bias force and cam structure releaseably retains the panels in a neat stacked condition when in open position and in accurate aligned condition when in closed position with the retention force being overcome when the panels are moved from their open or closed position.

A still further object of the invention is to provide a flat folding partition in accordance with the preceding objects in which the control mechanism limits the movement of the panels in the closing direction of movement to prevent the inward movement of the panels past an aligned position in a flat vertical plane.

An additional object of this invention is to provide a flat folding partition or door which includes two rows of rigid panels in accordance with the preceding objects in which multifunction controllers control movement of the panels between open and closed positions with the controllers being compact and economical in construction with all controllers utilizing the same components to facilitate manufacture, assembly and stocking of components.

Still another feature of the invention is to provide a flat folding partition in accordance with the preceding objects in which the control mechanism limits movement of the panels toward closed position beyond an aligned flat relation thereby preventing inward collapse beyond the flat closed position.

Yet another feature of the present invention is to provide a flat folding partition in accordance with the preceding objects including two rows of rigid panels which are retained in spaced relation by a control mechanism which interconnects a pair of panels in one row with a pair of panels in the other row to maintain the relationship of the panels and control their movement.

Yet another object of the invention is to provide a flat folding partition in accordance with the preceding objects in which movement of the panels from their stacked open position toward their planar closed position responds to a manual closing force sequentially moving the panels by overcoming the retention force provided by the cam structure and a spring biased cam follower.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
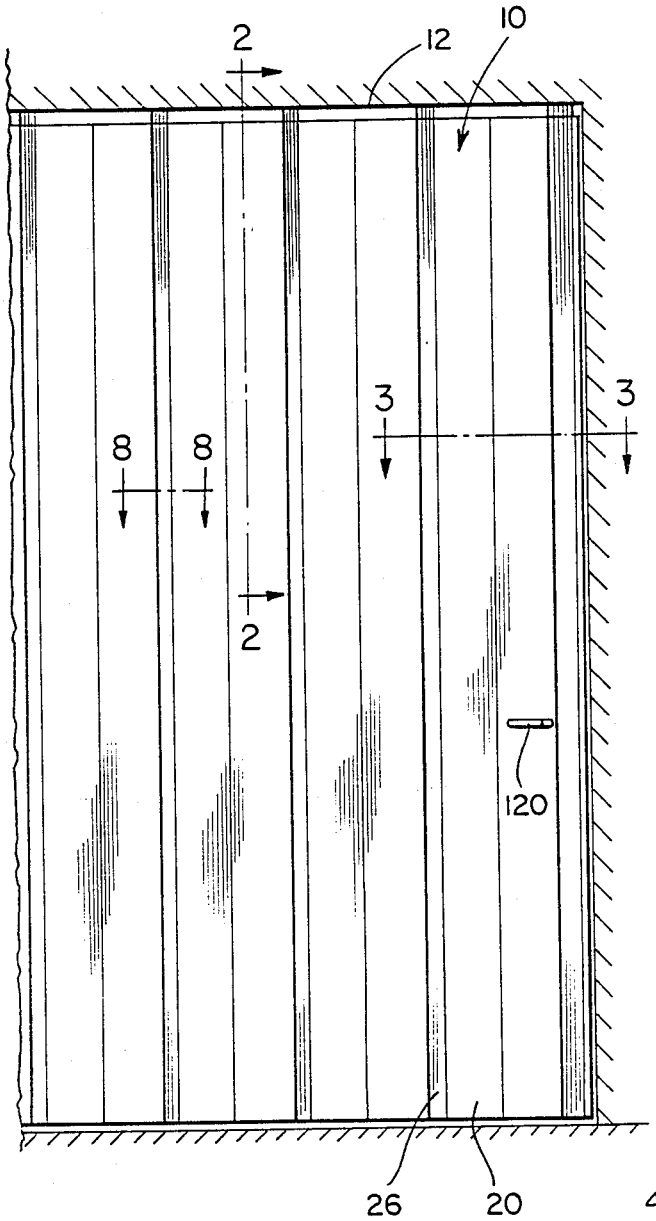
FIG. 1 is a side elevational view of a folding partition in accordance with the present invention.

Referring now specifically to the drawings, the flat folding partition of the present invention is generally designated by reference numeral 10 and is supported from an overhead ceiling 12 or the like having a trackway 14 incorporated therein or mounted thereon with the supporting structure including a roller equipped carriage 16 and a supporting assembly 18 connected thereto. While an overhead trackway has been shown in the drawings, a bottom, floor mounted trackway may also be provided with the partition being supported from either type of trackway. The support structure provides a support for a plurality of panels which are arranged in two parallel rows with the panels being designated by numerals 20 and 22 and which are rigid and of desired length and width.

Figure 4:
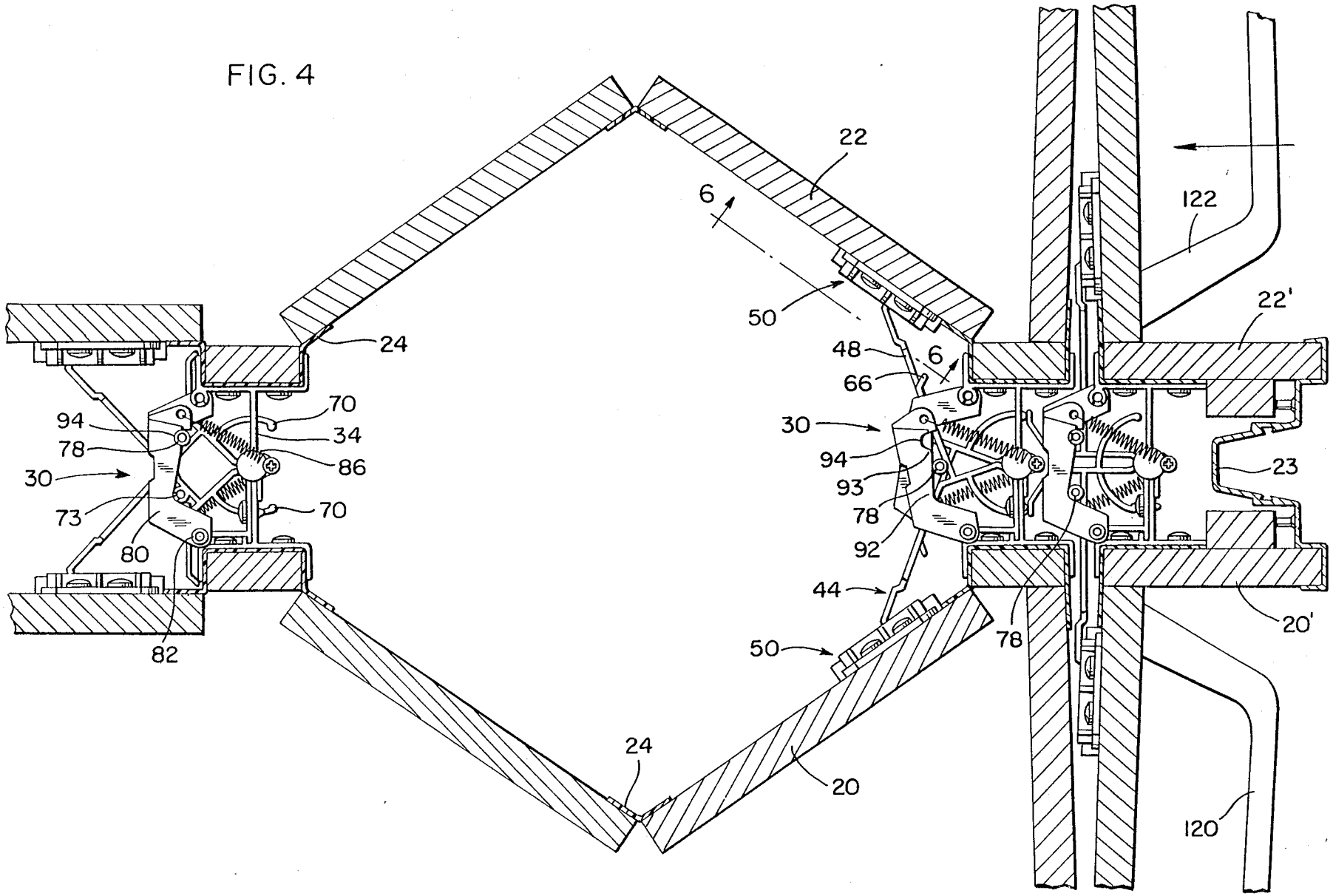
FIG. 4 is a sectional view, on an enlarged scale, similar to FIG. 3 but with the panels in partially open position illustrating the association of the components during movement in the opening direction.

The panels 20 in each wall of the dual wall partition are interconnected by hinge structures 24 and at every alternate panel, an intermediate connecting strip 26 is provided with the intermediate strip being connected to the adjacent panels by hinge structures 24. The specific details of the hinges 24 and the panels 20 and 22 may vary. As shown, intermediate strips 26 are the same thickness as the panels and are offset inwardly and have a horizontal width at least substantially equal to the thickness of two adjacent panels 20 or 22. Thus, when the panels 20 and 22 are oriented in closed position in parallel planes, they will be laterally offset outwardly of the intermediate strips 26 but when they are in open position in planes in face-to-face relation as illustrated in FIG. 4, the intermediate strips will receive the edges of the panels 20 and 22 so that the panels 20 and 22 can move from a position in spaced parallel generally vertical planes to a position in planes generally perpendicular to their original position. The panels are in a flat aligned condition when the partition is closed and in a compact stacked surface-to-surface relation when the partition is open. In an alternate construction, the intermediate strips may be oriented in the same plane as the panels and do not necessarily have to be a width twice the thickness of the panels.

The present invention includes a control mechanism 30 forming a multifunction controller located between and interconnecting the dual walls of the flat folding partition at the intermediate strips. The control mechanism 30 includes a control base generally designated by reference numeral 32 in the form of a vertically disposed rigid plate 34 generally perpendicular to the intermediate strips 26 and having an outwardly facing channel 36 on each vertical edge thereof which receives the intermediate strips 26 for rigid interconnection between the intermediate strips 26 for maintaining them in spaced vertical parallel planes. Suitable fasteners 38 secure the channels 36 to the intermediate strips 26. The plate 34 may be of one-piece construction or of two-piece construction as indicated at **34*a* and 34*b* which overlap and which are secured in rigid relation by fasteners 35 to enable assembly of the plate 34 with respect to the intermediate strips 26 by first securing members 34*a* and 34*b* to the strips by use of the fasteners 38 and then securing 34*a* and 34*b* together by use of fasteners 35. Also, the outer edges of plate 34 may be provided with flat attachment plates rather than channels 36 in structures in which strips 26 are in the same plane as panels 20 and 22 rather than being inwardly offset as shown. In this event the panels would be hinged at the outer edges of strips 26. Also, by changing the geometry of the components, the panels 20, 22 can be hinged directly to control base 32**.

Figure 6:
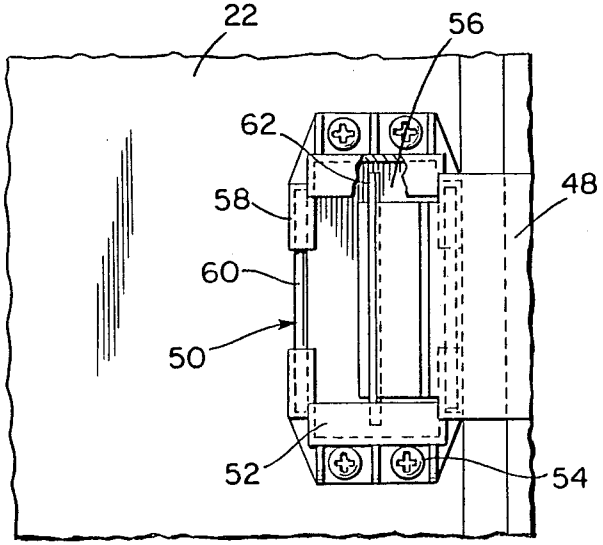
FIG. 6 is a fragmental elevational view with portions in section illustrating the structure of the connection between an angled control lever and a guide on an adjacent panel taken along reference line 6—6 on FIG. 4.
Figure 8:
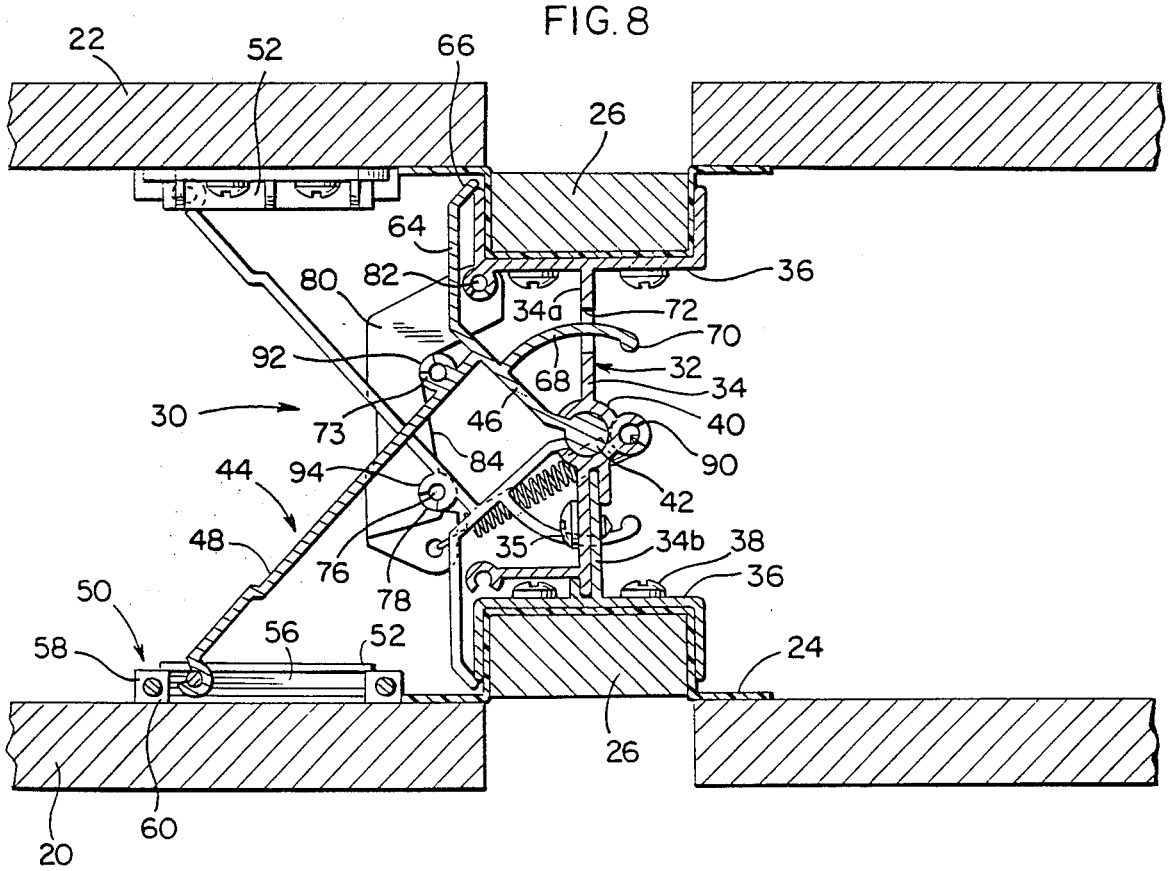
FIG. 8 is a sectional view similar to FIG. 7 and taken along section line 8—8 on FIG. 1 illustrating further structural details of the control mechanism between adjacent panels.

The central portion of the plate 34 is provided with a vertically disposed slotted tubular sleeve 40 which pivotally receives and engages a cylindrical member 42 formed on an end portion of an angled control lever 44 which is angulated with the cylindrical member 42 being integral with one end of a pivot arm 46 forming part of the angled control lever 44. The other end of the control lever formed by a lever arm 48 is slidably and pivotally connected to a control plate 50 affixed to the inner surface of a panel 20 or 22 with this structure being duplicated for both sets of panels 20 and 22. The control plate 50 is illustrated in FIG. 6 and includes a pair of end plates 52 attached to a panel 20 or 22 by screw threaded fasteners 54 with each of the end plates including an inwardly facing guide groove or slot 56. The plates 52 have inwardly facing edge sleeves 58 formed thereon for receiving alignment and anchoring rods 60 so that the plates 52 can be easily assembled with the end of the arm 48 having a projecting rod or pin 62 at each edge thereof for captive sliding and pivotal movement in the inwardly facing guide grooves 56. Thus, the end of the arm 48 forming part of the angled control lever 44 can move longitudinally in the guide grooves 56 and can pivot in the guide grooves 56 due to the pins 62 being slidably and captively received in the opposed guide grooves 56 as also illustrated in FIG. 8.

The control lever 44 also includes an actuator arm 64 which extends laterally from the end of the arm 48 and includes an angulated end 66. Also, the arm 46 includes an arcuate projection in the form of a starting arm 68 which has a rounded end generally of cylindrical configuration at 70 which extends through a slot 72 in the plate 34 as illustrated in FIG. 8 for engagement by the angulated end portion 66 on a control lever 44 from an adjacent control mechanism 30 as described hereinafter.

In addition, each of the control levers 44 also includes a vertically disposed tubular split sleeve 73 which extends outwardly of the lever at the juncture or adjacent the juncture of the arms 46 and 48 with this extension being designated by reference numeral 74 and having a pin 76 received therein that has a cam follower in the form of a control roller 78 or any other type of cam follower at the outer end thereof.

The control roller 78 engages the inner surface of a control cam 80 which has one end pivoted to a projecting pin 82 at an inner corner of the channel 36 with the control cam 80 generally being of shallow U-shaped or angulated construction and provided with a cam surface 84 on the inner surface thereof which is engaged by the control roller 78 which acts as a cam follower. The free end of the control cam 80, opposite to the pivot pin 82 has a control spring 86 in the form of a tension coil spring connected thereto with the other end of the tension coil spring being connected to a fastener or anchor pin 88 received in a tubular split sleeve 90 on the plate 34 generally in alignment with the sleeve 40 and forming an integral part of the sleeve 40. The cam surface 84 includes a recess 92 receiving the roller 78 when the panels are in their stacked open position and a recess 94 receiving the roller 78 when the panels are in their parallel closed position. Cam surface 84 also includes a raised surface area 93 between the recesses 92 and 94 and adjacent recess 94 with all of the cam surface 84 being smoothly connected to enable the control roller 78 to easily roll along the cam surface 84. The recess 92 is formed by the juncture between the bight portion and one leg of the U-shaped cam 80 while the recess 94 is arcuate to engage a portion of the periphery of the roller 78.

Figure 3:
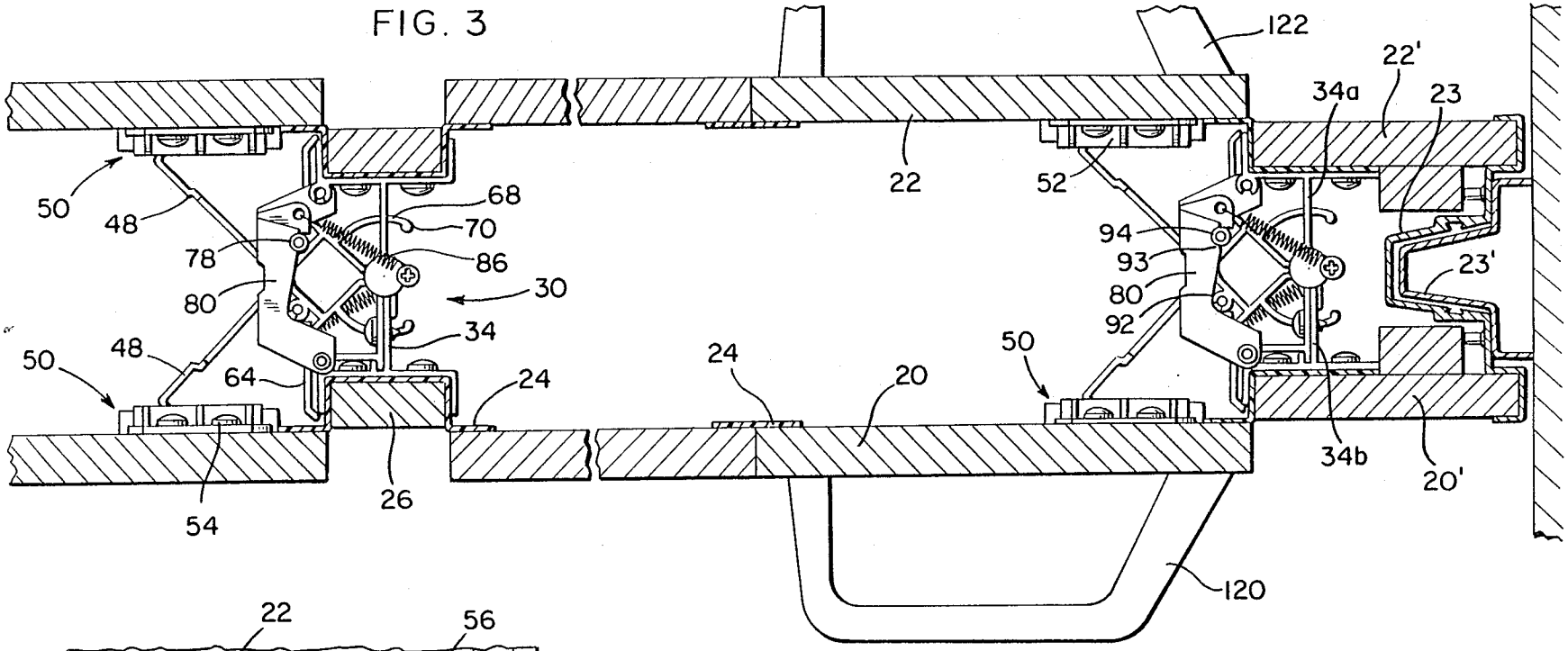
FIG. 3 is a transverse, sectional view taken substantially upon a plane passing along section line 3—3 on FIG. 1 illustration further structural details of the invention.

As shown, a single control base 32 has all of the control components connected thereto including a pair of control levers 44, a pair of control cams 80, a pair of control cam followers 78 and associated control springs 86. However, separate control bases 32 may be provided with each base including a single control lever, cam, cam follower and spring. Also, the control mechanism 30 may be provided at a single location between adjacent pairs of panels or may be duplicated and oriented in vertically spaced relation depending upon the length of the panels. As illustrated in FIGS. 3 and 8, when the panels 20 and 22 are oriented in spaced parallel vertical planes, the pins 62 on the ends of the arms 48 on the control levers 44 are disposed in the outermost ends of the guide grooves 56 which prevents the panels from folding in beyond flat closed position and the ends 70 of the starting arms 68 are disposed through the slots 72 in the plate 34. During opening movement of the partition, the angulated end 66 on the actuator arm 64 of a preceding control mechanism engages and moves the starting arm 68 towards the slot 72 thus exerting an outward force on the opposite panel to which that control lever 44 is connected as illustrated in broken line in FIG. 7 thus moving panels 20 and 22 to angled position and causing the hinged connections spaced from the intermediate strips to move outwardly thereby "breaking" the panels out of their aligned flat positions in spaced vertical planes which they occupy when in closed position. This transmittal of force from the opening movement of the preceding panels to the succeeding panels which are still in closed position provides an initial opening force to the succeeding closed panels. The spring biased cam surface 84 engaging the control roller 78 will resist this force until the control roller 78 moves out of recess 94 and just past raised area 93 with subsequent movement of the control roller 78 from raised area 93 to recess 92 providing a spring force to assist the panels to move to a completely stacked open position with the control roller 78 and recess 92 of the spring biased control cam holding the panels in a neat stacked relation when in their open position.

Figure 5:
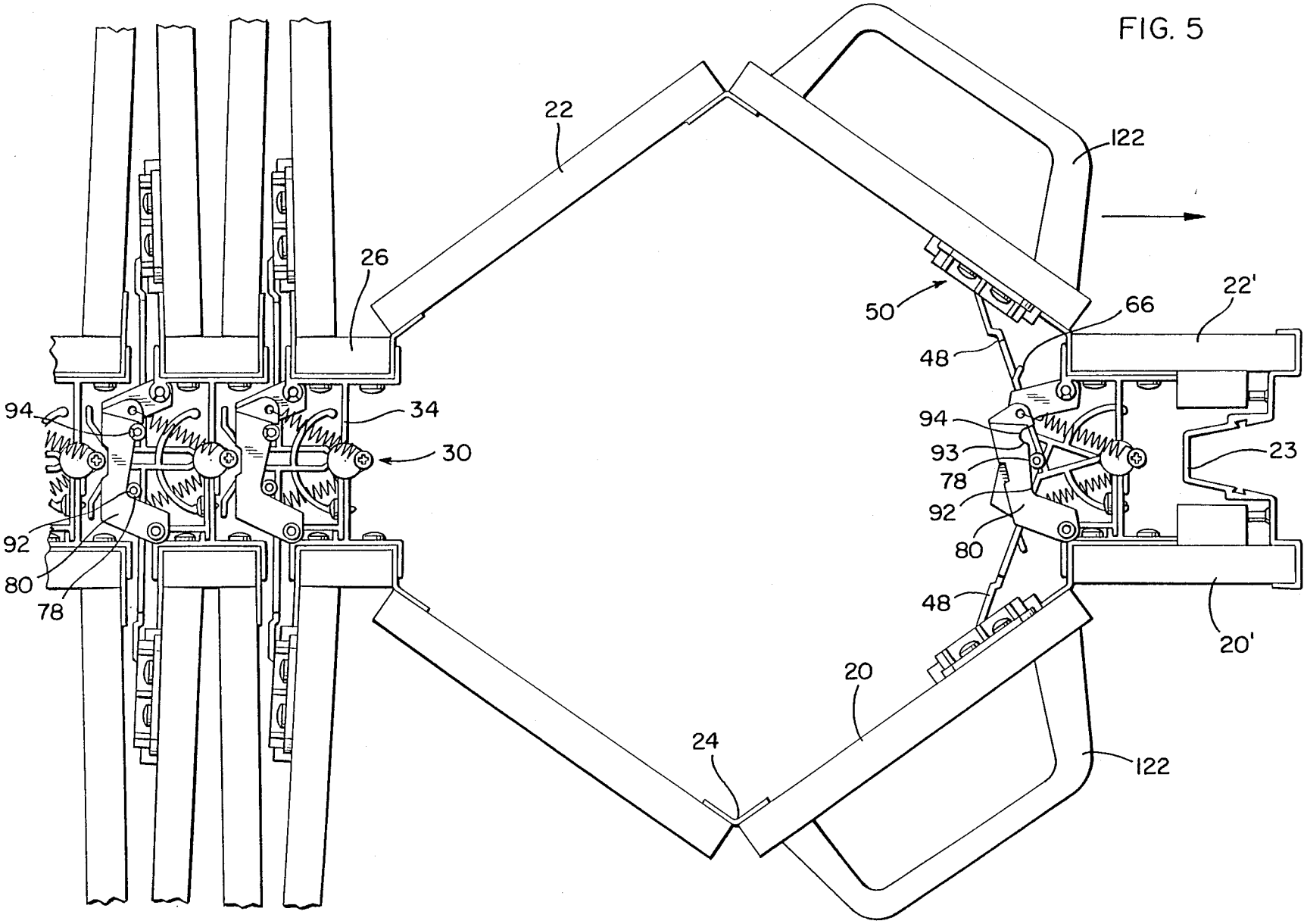
FIG. 5 is a view similar to FIG. 4 illustrating the association of the panels during movement in the closing direction.
Figure 7:
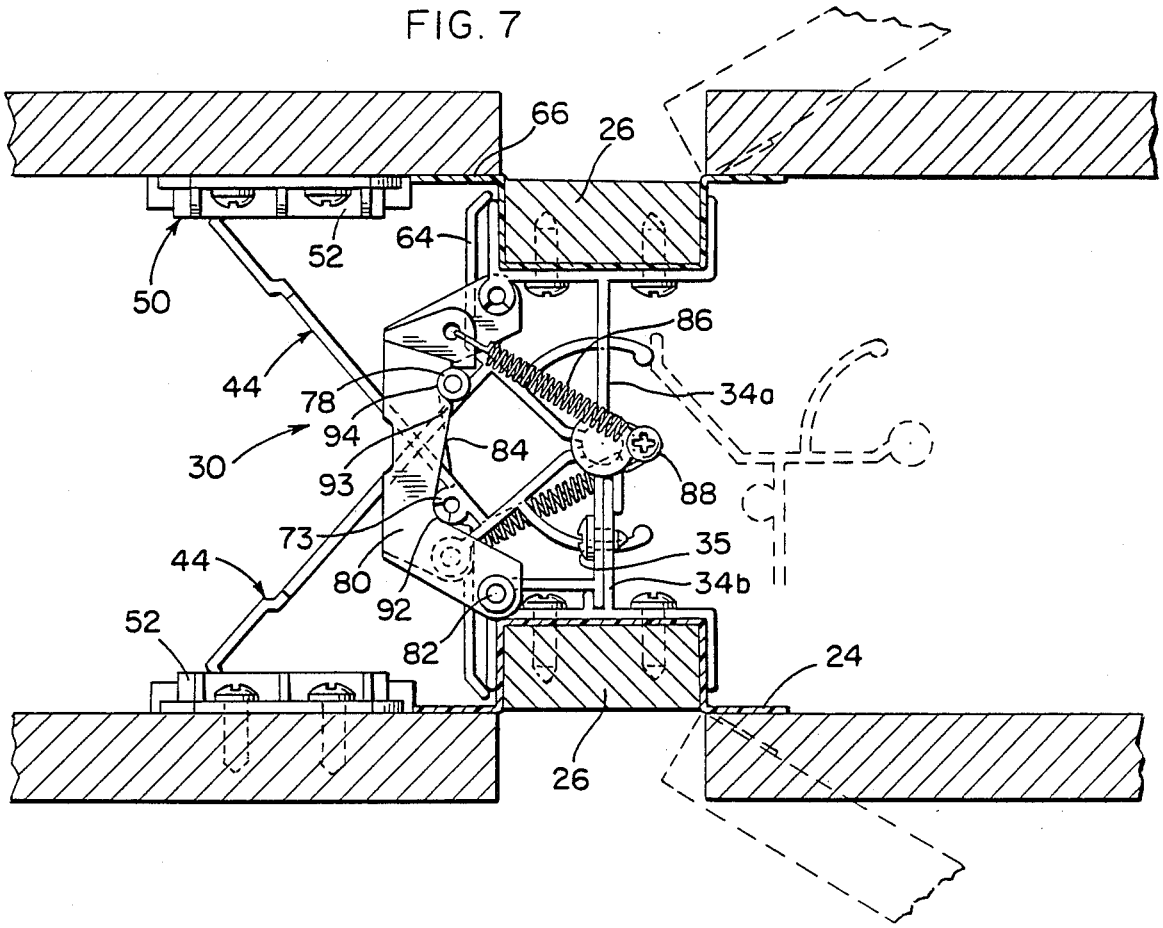
FIG. 7 is an enlarged fragmental sectional view illustrating the control mechanism connecting adjacent panels.

Thus, considering FIG. 4 as well as FIG. 7, the pair of panels 20 and 22 to the left which are still in spaced parallel relation remain so until the preceding pair of panels 20 and 22 assume a position substantially perpendicular to the intermediate strips 26 at which point the angulated end 66 of each of the control levers 44 operate and engage the starting arm 68 to exert an opening force or an outward force on the panels 20 and 22 so that they will be moved toward a shallow angled position in relation to the intermediate strips 26 thereby exerting an opening biasing force to "break" the panels from their parallel position toward an angled position. Considering FIG. 5, when the panels are in their open position in a parallel side-by-side opposed relationship as illustrated in FIG. 5, movement of the panels toward a closed position is resisted by the resilient bias exerted by control spring 86 on control cam 80 which resists movement of control roller 78 out of recess 92. This resistance is overcome by manual closing force exerted on the lead panel at the free edge of the partition. As this resistance is overcome control roller 78 moves along the control cam surface 84 toward the raised area 93. During this initial movement, the spring 86 is tensioned and as the control roller 78 moves past the raised area 93 into recess 94, the spring 86 then provides a bias to the control cam 80 and the control lever 44 which exerts a closing bias on the panel as the bias on the control lever 44 causes it to pivot about its pivotal connection with the plate 34.

Figure 2:
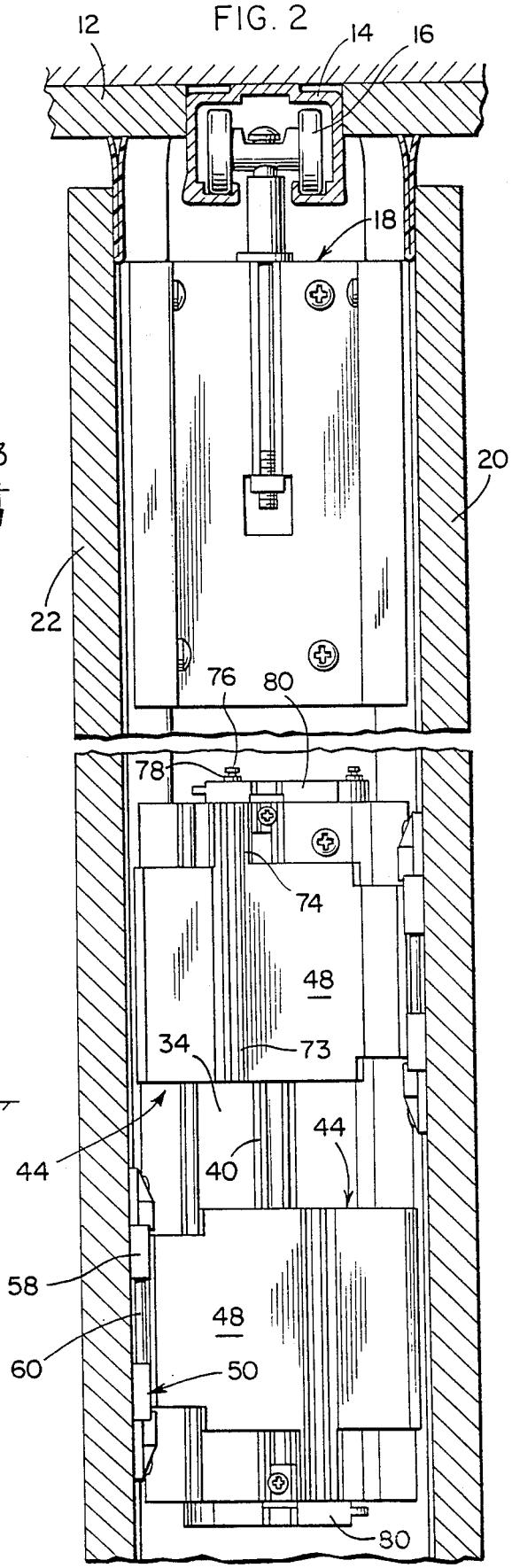
FIG. 2 vertical sectional view, on an enlarged scale, taken substantially upon a plane passing along section line 2—2 on FIG. 1 illustrating the structural details of the control mechanism between spaced parallel rows of panels which are pivotally interconnected at their inner edges.

As will be apparent from FIGS. 2, 7 and 8, the control levers, cams, springs, rollers and associated structure are duplicated at the top and bottom portion of the control base 32 and the control levers are associated in opposite direction with respect to the panels 20 and 22 with the arms 48 of the control levers 44 intersecting with respect to each other with the lowermost control lever being spaced downwardly from the uppermost control lever as illustrated in FIG. 2. Thus, as each pair of pivotally interconnecting panels 20 and 22 are moved toward an open position, the movement of the preceding pair of panels serves to initially break the panels from their completely closed position and exert a torque on the succeeding pair of panels for initially moving them from a closed position.

As illustrated in FIGS. 3 and 4, the endmost panels 20 and 22 are hingedly connected to relatively narrow panels 20' and 22' which are offset inwardly but may be in the same plane and rigidly interconnected at their outer ends by a connecting lead post 23 which cooperates with a jamb member 23' secured to a wall surface or the like in order to retain the partition closed with any suitable latch mechanism being provided. Handles 120 and 122 are rigidly affixed to the outer surface of the endmost panels 20' and 22' to provide an opening force to the partition and a closing force to the partition. The panels 20 and 20' and 22 and 22' are connected by hinge strips and also are connected by a control mechanism 30 which is the same as the control mechanism between the other pairs of panels. FIG. 3 discloses the components in a fully closed position and as outward force is exerted on the handles 120 or 122, the first pair of panels 20 and 22 will be pivoted toward the position illustrated in FIG. 4 so that when the panels 20 and 22 approach their fully open stacked position, the offset ends 66 on actuator arms 64 on the control levers on the first pair of panels will engage the cylindrical edges 70 on the starting arms 68 on the control levers on the next adjacent pair of panels thus transmitting an opening force on the adjacent pair of panels 20 and 22 which will move them to a shallow angular relation to the longitudinal center line of the partition as illustrated in FIG. 4. This procedure is repeated for each successive pair of panels during the opening movement. As illustrated in FIG. 5, the panels are moved from open stacked position by manually moving the handle and extending the first panels 20 and 22 which will be fully extended into a first volute due to less frictional resistance so that adjacent panels will be extended into a second volute after the first volute. This provides a sequential extension of the panels from the lead post toward the opposite edge of the partition.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A flat folding partition comprising two rows of substantially rigid panels, means hingedly connecting said panels along their vertical edges, means supporting the panels from a generally horizontal supporting surface for movement between open and closed positions, said rows of panels being oriented in spaced, parallel generally vertical planes with the panels of each row being in alignment when in closed position and movable to a stacked position generally perpendicular to the vertical planes when in open position, a control mechanism between the oppositely disposed panels with the control mechanism including means providing initial resilient resistance to movement of the panels from their open and closed positions and subsequently providing a spring bias force to the panels after the panels have passed an intermediate position during movement in the opening and closing directions for assisting in final movement of the panels in their opening and closing directions and means connected to said panels for transmitting initial opening force to succeeding panels from preceding panels during initial opening movement to initially pivot succeeding panels out of their vertical planes, said means for transmitting opening force being movably connected to said panels to exert opening force thereon in maximum spaced relation to the means hingedly connecting the panels with the means connected to said panels for transmitting opening force thereto moving towards the means hingedly connecting the panels as the panels move toward open position.

2. The folding partition as defined in claim 1 wherein said control mechanism includes a transversely extending control base having adjacent panels hingedly associated therewith and forming said means hingedly connecting said panels, a control lever pivotally supported from said base, one end of said control lever being pivotal and slidable relative to one of said panels and forming said means for transmitting opening force to the panels.

3. The folding partition as defined in claim 2 together with a control plate mounted on each panel, means slidably and pivotally connecting a end of the control lever to said control plate in a manner to captively retain the end of the control lever adjacent the inner surface of the panel for exerting outward force on the panels in maximum spaced relation to their hinge axes.

4. The folding partition as defined in claim 2 wherein said control lever includes a pair of projecting arms with one of the arms extending through an opening in the control base and positioned in the path of movement of the other arm of a control lever on a preceding adjacent panel for engagement thereby during final movement of the preceding panel to open position.

5. A flat folding partition comprising two rows of substantially rigid panels, means hingedly connecting said panels along their vertical edges, means supporting the panels from a generally horizontal supporting surface for movement between open and closed positions, said rows of panels being oriented in spaced, parallel generally vertical planes with the panels of each row being in alignment when in closed position and movable to a stacked position generally perpendicular to the vertical planes when in open position, a control mechanism between the oppositely disposed panels with the control mechanism including means providing initial resistance to movement of the panels from their open and closed positions and providing a spring bias force to the panels after the panels have passed an intermediate position during movement in the opening and closing directions for assisting in final movement of the panels in their opening and closing directions and means transmitting initial opening force to succeeding panels from preceding panels during initial opening movement to initially pivot succeeding panels out of their vertical planes, said control mechanism including a transversely extending control base having adjacent panels hingedly associated therewith, a control lever pivotally supported from said base, one end of said control lever being pivotal and slidable relative to one of said panels, said means biasing the panels toward open and closed position including a control cam mounted pivotally on the control base, said including a control cam mounted pivotally on the control base, said cam being elongated and including a cam surface and control spring means interconnecting the cam and control base to bias the cam in one pivotal direction, said control lever including a control cam follower engaged with the cam surface on the control cam whereby the spring biased cam will exert pivotal spring bias pressure onto the control lever, said cam surface including an intermediate raised surface area and end recess so that when the control cam follower moves past the raised surface area, the cam follower will be spring biased towards the end recess for exerting spring bias on the control lever to exert force on the panel connected to the end of the control lever.

6. The folding partition as defined in claim 5 wherein said control lever is pivotally connected to the control base adjacent the central portion thereof and extends therefrom for connection with the inner surface of a panel.

7. The folding partition as defined in claim 5 wherein said cam follower is a roller rotatably journalled on said control lever.

8. A flat folding partition comprising two rows of substantially rigid panels, means hingedly connecting said panels along their vertical edges, means supporting the panels from a generally horizontal supporting surface for movement between open and closed positions, said rows of panels being oriented in spaced, parallel generally vertical planes with the panels of each row being in alignment when in closed position and movable to a stacked position generally perpendicular to the vertical planes when in open position, a control mechanism between the oppositely disposed panels with the control mechanism including means providing initial resistance to movement of the panels from their open and closed panels have passed an intermediate position during movement in the opening and closing directions for assisting in final movement of the panels in their opening and closing directions and means transmitting initial opening force to succeeding panels from preceding panels during initial opening movement to initially pivot succeeding panels out of their vertical planes, said control mechanism including a transversely extending control base having adjacent panels hingedly associated therewith, a control lever pivotally supported from said base, one end of said control lever being pivotal and slidable relative to one of said panels, said control lever including a pivot arm and a lever arm in angular relation to each other with the free end of the pivot arm being connected to the control base and the free end of the lever arm being connected to the panel, said pivot arm including a starting arm having an end edge projecting through an opening in the control base, the pivot arm having an actuator arm attached thereto adjacent its intersection with the lever arm and extending laterally from the pivot arm and terminating in an angled inclined end portion.

9. The folding partition as defined in claim 8 wherein adjacent panels in each vertical plane are interconnected by an intermediate strip with the control base rigidly interconnecting the intermediate strips, said intermediate strips having a width at least equal to twice the thickness of the panels so that the adjacent panels interconnected by the intermediate strip may be oriented in generally perpendicular relation thereto when the panels are in open position and in parallel offset relation thereto when the panels are in closed position.

10. The folding partition as defined in claim 8 wherein said control base includes a pair of overlapping plates rigidly secured together by fasteners, means at the outer edge portions of said control base for connection with said panels, said pair of plates being secured together after connection with the panels to facilitate assembly of the control base and panels.

11. The folding partition as defined in claim 8 wherein a pair of control levers are pivotally mounted on said control base, said control levers extending angularly in intersecting planes for slidable and pivotal connecting with adjacent panels.

12. A dual folding partition comprising two rows of rigid panels connected along vertical edges for pivotal movement between extended position with the panels arranged in spaced parallel planes and retracted position with the panels folded into angular relation to the parallel planes, means guidingly supporting said panels during movement between extended and retracted positions, said panels in each row being arranged in pairs, a control mechanism interconnecting the panels in one row with the panels in the other row, said control mechanism exerting a retracting force on succeeding panels when preceding panels are moved from an extended position toward a retracted position and providing an initial retracting force to succeeding panels during final retracting movement of preceding panels, said control mechanism including a control cam assembly and biasing means to resiliently hold the panels in extended and retracted position, said biasing means and control cam assembly also biasing the panels toward extended position after initial movement from their retracted position.

13. The folding partition as defined in claim 12 wherein said control mechanism includes a rigid base extending transversely between and hingedly associated with adjacent edges of adjacent panels, a control lever pivotally connected to the rigid base, said control lever including a control arm slidably and pivotally connected to the inner surface of an adjacent panel for exerting force on the panel in spaced relation to the hinge axis of the panel.

14. The folding partition as defined in claim 12 wherein said control cam assembly includes an elongate control cam having one end pivotally connected to said rigid base in spaced relation to the pivotal connection between the control lever and rigid base, said biasing means including a spring connecting the cam with said rigid base to bias the cam pivotally toward said rigid base, a cam surface on the cam, a cam follower mounted on said control lever and engaging the cam surface on the cam to exert a spring biased force on said control lever and adjacent panel when the follower moves along the spring biased cam.

15. The folding partition as defined in claim 14 wherein said cam surface includes a high surface area and end recesses to bias movement of the adjacent panel depending upon the position of the follower in relation to the cam surface, the recesses in the cam surface forming seats to receive the follower when the panels are in extended or retracted position for retaining the panels in parallel and stacked positions with resistance to movement of the panels from said positions being provided by said spring, cam, cam surface and follower.

16. A dual folding partition comprising two rows of rigid panels connected along vertical edges for pivotal movement between extended position with the panels arranged in spaced parallel planes and retracted position with the panels folded into angular relation to the parallel planes, means guidingly supporting said panels during movement between extended and retracted positions, said panels in each row being arranged in pairs, a control mechanism interconnecting the panels in one row with the panels in the other row, said control mechanism exerting a retracting force on succeeding panels when preceding panels are moved from an extended position toward a retracted position and providing an initial retracting force to succeeding panels during final retracting movement of preceding panels, said control mechanism including a rigid base extending transversely between and hingedly associated with adjacent edges of adjacent panels, a control lever pivotally connected to the rigid base, said control lever including a control arm slidably and pivotally connected to the inner surface of an adjacent panel for exerting force on the panel in spaced relation to the hinge axis of the panel, said control lever also including an actuator arm having an end portion projecting toward a lever of a succeeding control mechanism.

17. The folding partition as defined in claim 16 wherein said control lever also includes a starting arm having an end portion engaged by the end portion of the actuator arm on a control lever connected with a preceding panel during retracting movement to exert an initial retracting force on the succeeding panel.

18. A control mechanism for a folding partition having a plurality of vertically elongated rigid panels having their adjacent vertical edges connected for pivotal movement between a closed position with the panels in alignment and an open position with the panels folded into stacked relation, said panels being arranged in spaced parallel rows to form a dual wall partition, said mechanism comprising means adapted to interconnect the rows of panels, said means including means adapted to resiliently retain the panels in open and closed positions, prevent inward pivotal movement of the panels beyond their aligned closed position, resiliently bias the panels toward open and closed positions after the panels have moved past an intermediate position in both an opening and closing direction of movement and transmit an initial opening force from preceding panels to succeeding panels in each row as the preceding panels in each row approach their open position.

19. The control mechanism of claim 18 wherein said means adapted retain the panels in both positions includes a resiliently biased control cam and cam follower with the cam having a cam surface with spaced areas adapted to correspond to the open and closed positions of the panels, said areas receiving said follower with the resiliently biased cam resiliently retaining the follower in engagement with said areas.

20. The control mechanism as defined in claim 18 wherein said means adapted to bias the panels toward open and closed positions includes a resiliently biased cam having a cam surface high area between two low areas adapted to correspond to the open and closed position of the panels, a cam follower engaged with the cam surface, said cam biasing the cam follower toward the low areas after the follower has passed the high area on the cam during movement of the panels in an opening or closing direction.

21. The control mechanism as defined in claim 18 wherein said means adapted to transmit an opening force includes a control lever adapted to be pivotally supported between the rows of panels and including an actuator arm, one end of said lever adapted to be slidably and pivotally connected with a succeeding panel to limit movement of succeeding panels and prevent inward movement thereof when the panels move to aligned closed position, said lever also including a starter arm disposed in the path of movement of the actuator arm on the lever of a preceding panel to pivot the lever when the preceding panel approaches an open position and adapted to transmit an opening force to the succeeding panel.

* * * * *